US007367841B1

(12) United States Patent
Lin

(10) Patent No.: US 7,367,841 B1
(45) Date of Patent: May 6, 2008

(54) METALLIC HOUSING STRUCTURE FOR USB CONNECTORS

(75) Inventor: Chin-Huang Lin, Jhonghe (TW)

(73) Assignee: Long Chang Technology Co., Ltd., Taipei County (TW)

( * ) Notice: Subject to any disclaimer, the term of this patent is extended or adjusted under 35 U.S.C. 154(b) by 0 days.

(21) Appl. No.: 11/639,269

(22) Filed: Dec. 15, 2006

(30) Foreign Application Priority Data

Nov. 15, 2006 (TW) ..... 95220144 U

(51) Int. Cl.
*H01R 13/648* (2006.01)

(52) U.S. Cl. ..... 439/607

(58) Field of Classification Search ..... 439/607, 439/608, 609, 610, 108
See application file for complete search history.

(56) References Cited

U.S. PATENT DOCUMENTS 4,653,825 A * 3/1987 Olsson ..... 439/295
5,518,421 A * 5/1996 Davis ..... 439/607
5,725,395 A * 3/1998 Lee ..... 439/610
5,944,559 A * 8/1999 Wu ..... 439/607
6,165,016 A * 12/2000 Lai ..... 439/610
6,390,852 B1 * 5/2002 Wang ..... 439/610
6,508,678 B1 * 1/2003 Yang ..... 439/677
6,659,801 B2 * 12/2003 Nishio et al. ..... 439/610
6,783,397 B2 * 8/2004 Yang Lee ..... 439/607
D503,683 S * 4/2005 Wang ..... D13/147
D510,725 S * 10/2005 Lai et al. ..... D13/147
7,033,218 B2 * 4/2006 Huang et al. ..... 439/607
D523,816 S * 6/2006 Su ..... D13/147
D525,939 S * 8/2006 Lai ..... D13/147
2005/0245132 A1 * 11/2005 Huang et al. ..... 439/607
2006/0166555 A1 * 7/2006 Zhao et al. ..... 439/607

* cited by examiner

*Primary Examiner*—Tulsidas C. Patel
*Assistant Examiner*—Vladimir Imas
(74) *Attorney, Agent, or Firm*—Rosenberg, Klein & Lee

(57) ABSTRACT

A metallic housing structure for USB connectors, includes a housing body and a lid body. The housing body has a base plate, two side plates extending up from the two sides of the base plate and a top plate connected to the upper front of the two side plates. The back part of the top of the housing body forms an opening hole. The lid body is formed as a integral piece and is connected to the housing body. The lid body can close up the opening hole. Thus, a metallic housing structure is formed that reduced material and molding costs, increases production efficiency and offers better electromagnetic shielding.

7 Claims, 7 Drawing Sheets

METALLIC HOUSING STRUCTURE FOR USB CONNECTORS

BACKGROUND OF THE INVENTION

1. Field of the Invention

The present invention relates to a metallic housing, and particularly relates to a metallic housing applied to USB connectors. The metallic housing structure for USB connectors will decrease costs, increase efficiency, and the improved electromagnetic shielding effect.

2. Description of the Related Art

As electronic devices become smaller and more versatile, the need for improved electronic connectors increases. The connectors not only need to transmit data better, but also feature smaller and simpler structures. Universal Serial Bus (USB) connectors have become the common input/output interfaces. The common specifications of USB connectors in the market are A type, B type, and mini type USB connector extras. USB connectors can be connected to one end of a cable, becoming a cable connector.

The above-mentioned USB connector comprises an insulation body, a plurality of terminals, and a metallic housing body. The terminals are installed on the insulation body. The metallic housing body wraps around the outside of the insulation body for protection and electromagnetic shielding.

However, in regards to the above-mentioned USB connector, the design of the metallic housing body is in two parts. This increases the cost of materials and requires the opening of separate molds. Thus, using two molds increases the costs of molding. Furthermore, the two-part metallic housing body wastes time and labor in the assembling stage and is unsuitable for automatic production. Electromagnetic shielding is also impacted.

SUMMARY OF THE INVENTION

One particular aspect of the present invention is to provide a metallic housing structure for USB connectors, decreasing the cost of materials and molding and increasing production efficiency, and offering better electromagnetic shielding.

In order to achieve the above-mentioned aspects, the present invention provides a metallic housing structure for USB connectors, comprising a housing body having a base plate, two side plates, and a top plate. The two side plates are formed by extending up from two sides of the base plate. The top plate is connected to the upper front part of the two side plates. The back part of the top of the housing body forms an opening hole; a lid body, formed integrally and connected to the housing body. The lid body can close up the opening hole.

The present invention has the following advantages: the lid body of the present invention is connected to the housing body in a single piece, making the metallic housing body in a one-piece structure. This decreases the material costs and does not require opening a separate mold. Using one set of molds decreased the molding cost. The single piece design saves a lot of time and labor in the assembling stage and facilitates automatic production. This effectively increases production efficiency and offers better electromagnetic shielding.

It is to be understood that both the foregoing general description and the following detailed description are exemplary, and are intended to provide further explanation of the invention as claimed. Other advantages and features of the invention will be apparent from the following description, drawings and claims.

DETAILED DESCRIPTION OF THE PREFERRED EMBODIMENTS

Figure 1:
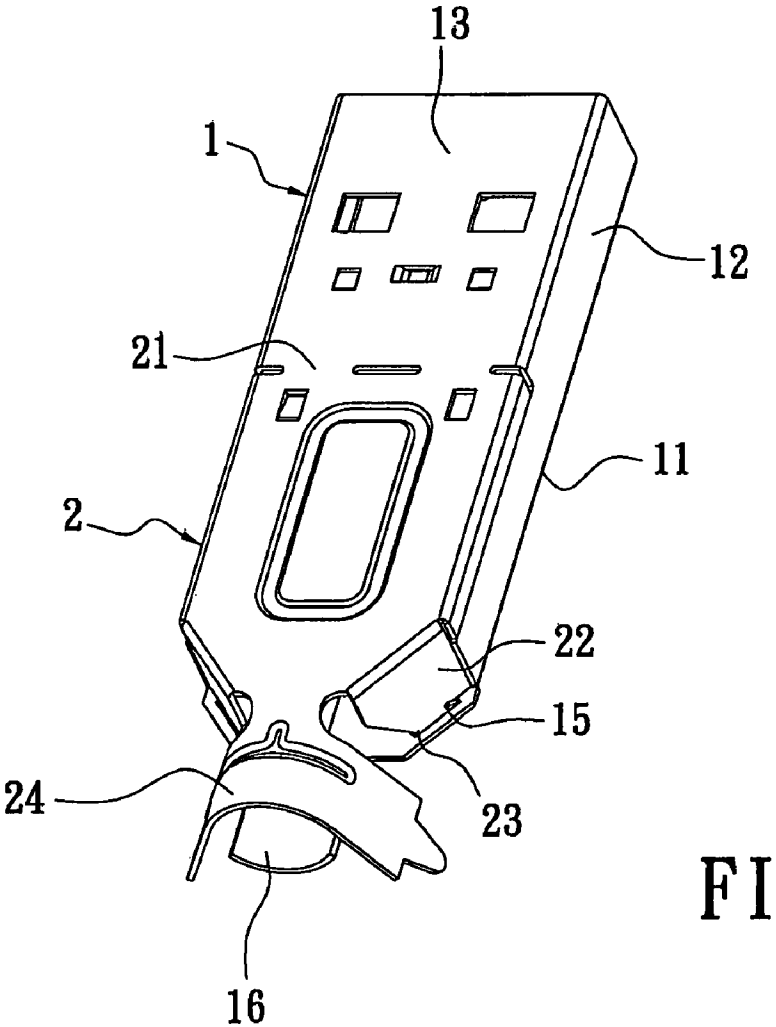
FIG. 1 is a three-dimensional view of the first embodiment of the metallic housing of the present invention.
Figure 2:
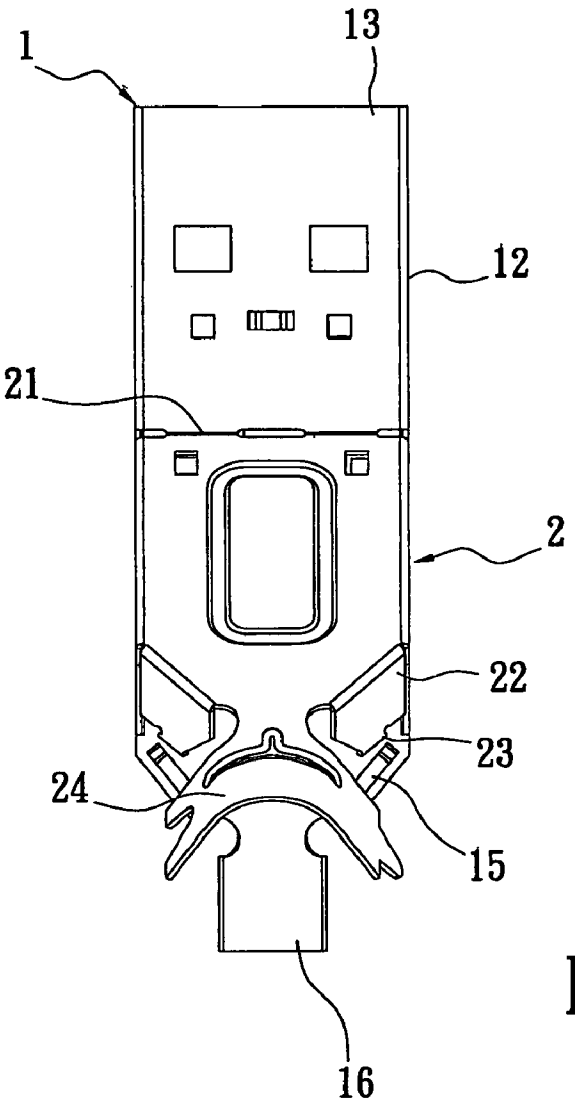
FIG. 2 is a bird's eye view of the first embodiment of the metallic housing in opening status of the present invention.
Figure 3:
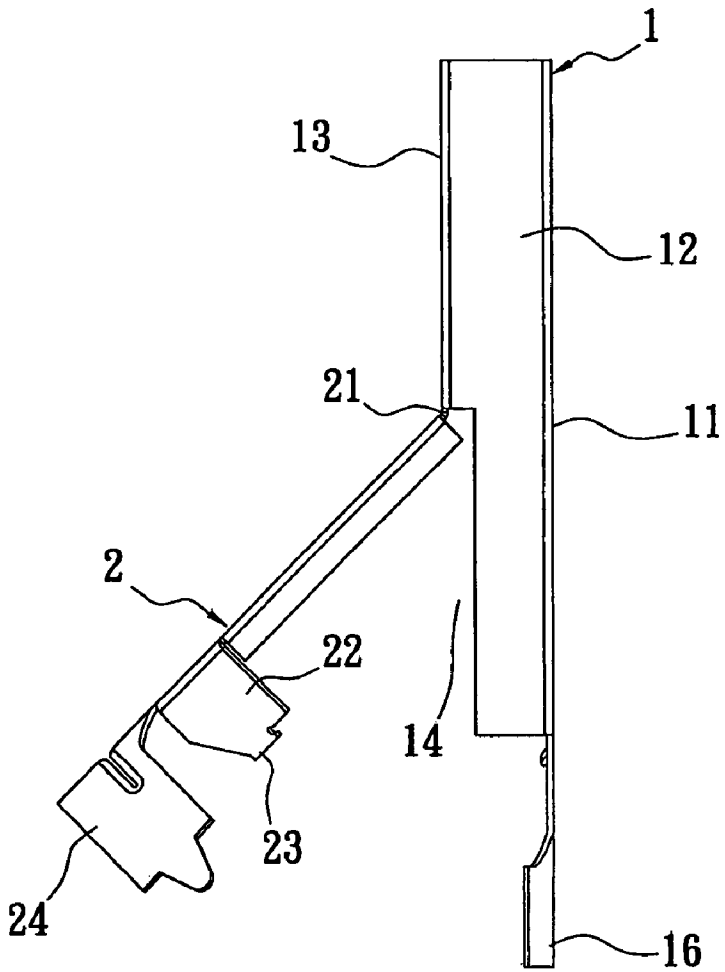
FIG. 3 is a side view of the first embodiment of the metallic housing in opening status of the present invention.

Please refer to FIGS. 1 to 3. The present invention provides a metallic housing structure for USB connectors. The embodiment expresses a metallic housing for an A type USB connector. The metallic housing comprises a housing body 1 and a lid body 2. The housing body 1 has a base plate 11, two side plates 12, and a top plate 13. The base plate 11 is formed like a rectangular plate. The two side plates 12 are formed by extending up from two sides of the base plate 11. The top plate 13 is connected to the upper front of the two side plates 12. The front end and back end of the housing body appear as an opening hole and the upper back of the housing body 1 forms an opening hole 14 for fitting the insulation body (plastic bud) of the USB connector. There is a clip-connecting hole 15 disposed near the two sides of the back of the base plate 11 of the housing body 1. The back of the base plate 11 is connected in parallel to a first clipping plate sheet 16 for clipping the cables.

The lid body 2 is connected to the housing body 1 in a integral piece. The lid body 2 is formed like a rectangular plate body. The lid body is connected to the back of the top plate 13 by a connecting part 21, making the lid body 2 correspond to the opening hole 14 of the housing body 1 for closing and opening movements. After the lid body 2 closes up the opening hole 14, the housing body 1 and the lid body 2 forms a complete metallic housing. A back plate 22 extends out from the back of both of the two sides of the lid body 2. One end of the back plate 22 forms a clip-connecting body 23. The clip-connecting body 23 corresponds to the clip-connecting hole 15 so that the lid body 2 can firmly cover the housing body 1 with clip-connecting body 23 wedged with the clip-connecting hole 15 and the back plate 22 covering the back end of the housing body 1. The back of the lid body 2 is connected in parallel to a second clipping plate sheet 24 for clipping the cables. According to the above-mentioned formation, the structure of the USB connector of present invention is formed.

As FIGS. 2 and 3 show, before the installation of the insulation body of the USB connector, the lid body 2 of the metallic housing appears in open state. After the installation of the insulation body inside the metallic housing, the lid body 2 is closed over the opening hole 14 of the housing body 1. Therefore, the insulation body will be wrapped around by the metallic housing. Furthermore, the clip-connecting body 23 is used to clip and connect to the corresponded clip-connecting hole 15, making the lid body 2 firmly closed on the housing body 1. Moreover, the cable can be connected to the terminal of the USB connector and disposed between the two clipping plates 16 and 24. The clipping plates 16 and 24 clip the cables firmly so that the USB connector can be connected to the cables.

Figure 4:
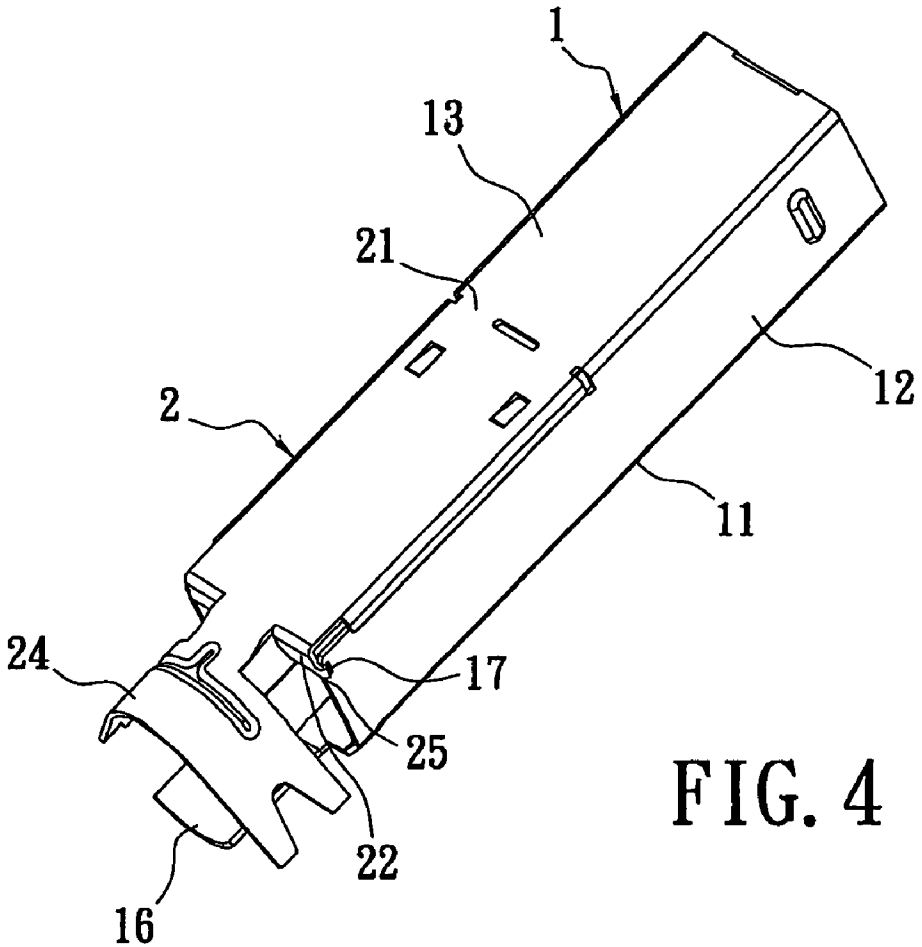
FIG. 4 is a three-dimensional view of the second embodiment of the metallic housing of the present invention.
Figure 5:
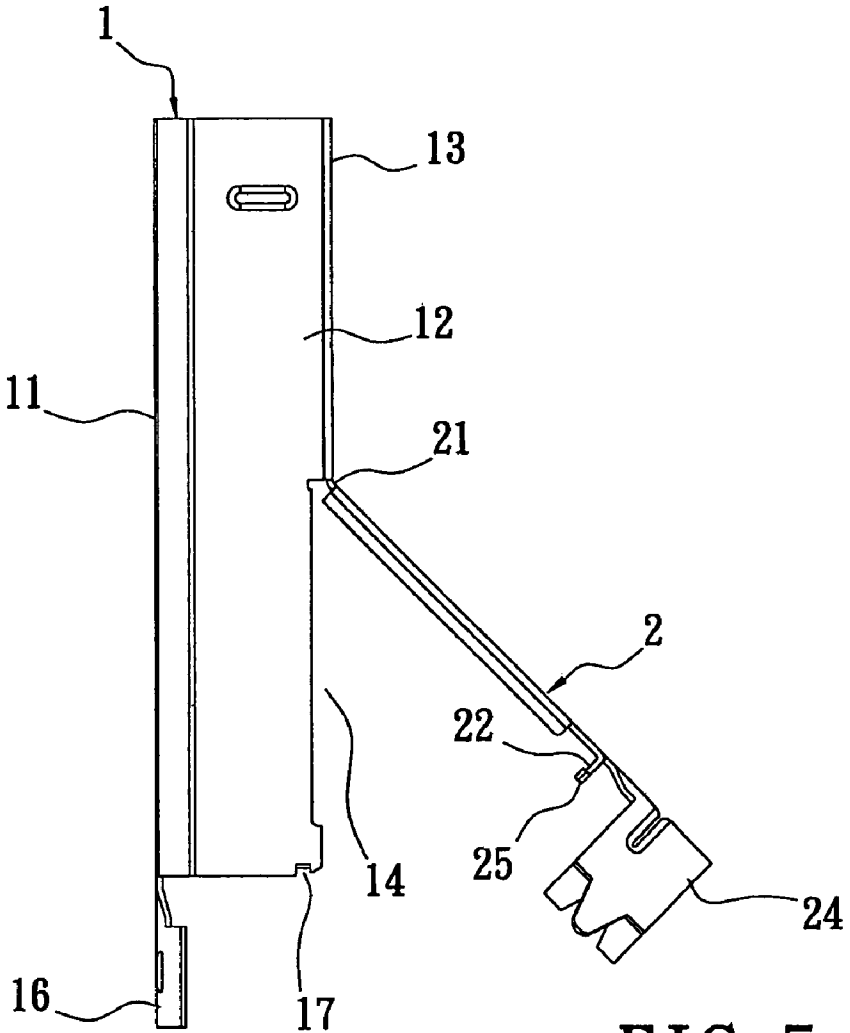
FIG. 5 is a side view of the second embodiment of the metallic housing in opening status of the present invention.

Please refer to FIGS. 4 and 5. The second embodiment expresses a metallic housing for a B type USB. The difference between the first and second embodiment is the difference in specification. A protruding buckle 25 is formed on each end of the two back plates 22 at the back of the lid body 2. There is a buckle slot 17 on each of the upper rims of the back of the side plates 12 on the housing body 1. After the lid body 2 closes up the opening hole 14, the protruding buckle 25 can be buckled to the corresponding buckle slot 17, making the lid body 2 firmly cover the housing body 1.

Figure 6:
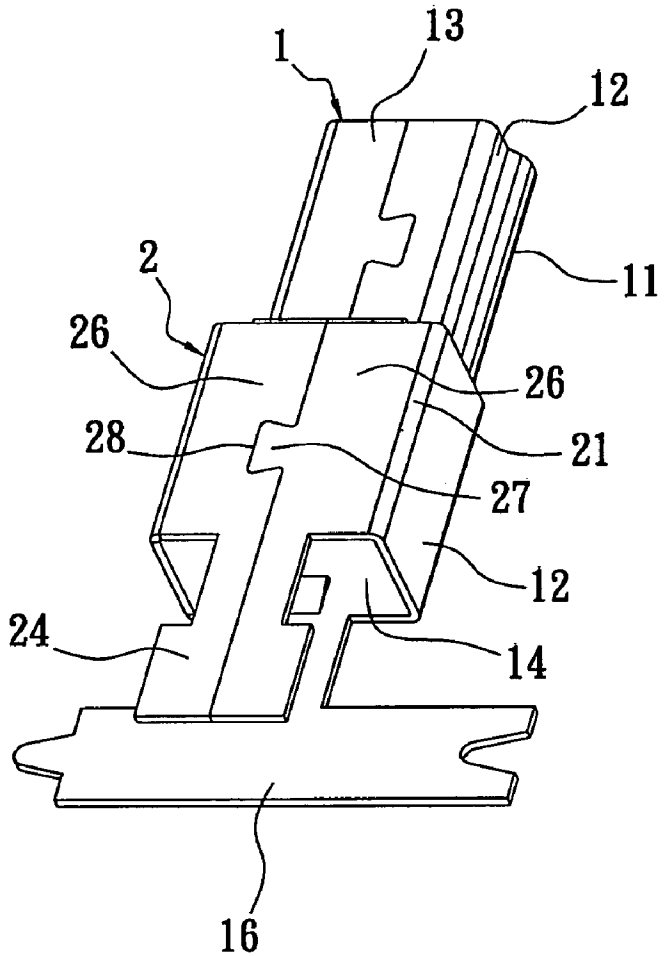
FIG. 6 is a three-dimensional view of the third embodiment of the metallic housing of the present invention.
Figure 7:
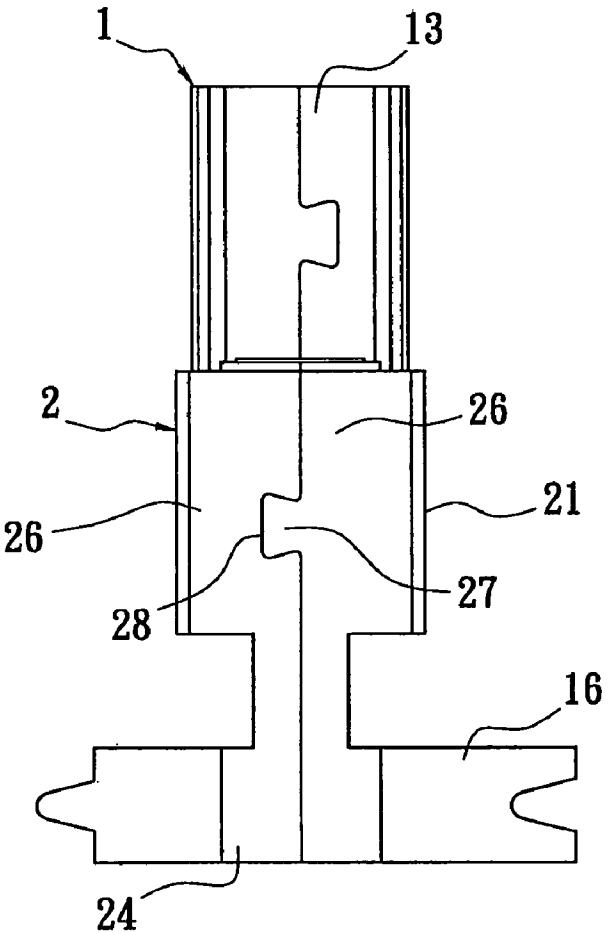
FIG. 7 is a side view of the third embodiment of the metallic housing in opening status of the present invention.

Please refer to FIGS. 6 and 7. The third embodiment expresses a metallic housing for a mini type USB. The difference between the first, second and third embodiment is the differences in specification. The lid body 2 is differentiated into two lid plates 26. One side of the two lid plates 26 is connected to the upper part of the two side plates 12 by the connecting part 21, so that the two lid plates 26 correspond to the opening hole 14 of the housing body 1, causing a closing or opening action. A corresponding protruding buckle 27 and a buckle slot 28 is disposed on the connecting side of the two lid plates 26. After the two lid plates 26 of the lid body 2 close together, the protruding buckle 27 can be buckled to the corresponding buckle slot 28, making the lid body 2 firmly cover the housing body 1.

The lid body 2 of the present invention is connected to the housing body 1 in a integral piece, making the metallic housing body a integral piece structure. This decreases the material costs and does not require the opening of a separate mold. Using one set of molds decreases the molding cost. Furthermore, the integral piece metallic housing saves time and labor in the assembling stage and facilitates automatic production. This effectively increases production efficiency and offers better electromagnetic shielding.

Although the present invention has been described with reference to the preferred best molds thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A metallic housing structure for USB connectors, comprising:

a housing body formed integrally in one-piece formation and having a cavity surrounded by a longitudinally extended base plate, two side plates and a top plate, the two side plates formed by extending up from the two longitudinal sides of the base plate, the top plate having a first end portion connecting to an upper front part of the two side plates, the top plate having a second end portion longitudinally spaced from the first end portion and defining a lid body and a connecting part disposed between said first and second end portions, the connecting part being perforated by a plurality of openings spaced one from another transversely across the top plate to adapt the lid body to be reversibly angularly displaced relative to the first end portion and thereby expose and form a closure for an opening hole in open communication with the cavity to provide access thereto.

2. The metallic housing structure for USB connectors as claimed in claim 1, wherein a clip-connecting hole is respectively disposed near each of the two sides of the back of the base plate of the housing body, a back plate extends out to both of the two sides of the back of the lid body, one end of the back plate forming a clip-connecting body, after the lid covers the opening hole, the two back plates shelter the back of the housing body and the clip-connecting body clips and connects to the clip-connecting hole.

3. The metallic housing structure for USB connectors as claimed in claim 1, wherein the back of the base plate is connected to a first clipping plate sheet.

4. The metallic housing structure for USB connectors as claimed in claim 3, wherein the back of the lid body is connected to a second clipping plate sheet.

5. The metallic housing structure for USB connectors as claimed in claim 1, wherein a back plate extends out to both of the two sides of the back of the lid body, one end of the both two back plates forming a protruding buckle, the upper rim of the back of the both two side plates of the housing body having a buckle slot, the lid body covers being secured over the opening hole by clipping and connecting the protruding buckle and the buckle slot.

6. The metallic housing structure for USB connectors as claimed in claim 1, wherein the USB connector is an A type, a B type or a Mini type.

7. The metallic housing structure for USB connectors as claimed in claim 1, wherein the USB connector is a cable connector.

* * * * *